United States Patent [19]

Kranefeld et al.

[11] Patent Number: 4,586,217

[45] Date of Patent: May 6, 1986

[54] GRATE FOR A FIBER BALE OPENER

[75] Inventors: Andreas Kranefeld, Erkelenz; Axel Thannheiser, Hof, both of Fed. Rep. of Germany

[73] Assignee: Trützschler GmbH & Co. KG, Mönchengladbach, Fed. Rep. of Germany

[21] Appl. No.: 694,252

[22] Filed: Jan. 24, 1985

[51] Int. Cl.[4] ..... D01G 7/12

[52] U.S. Cl. ..... 19/80 R; 19/81

[58] Field of Search ..... 19/80 R, 81

[56] References Cited

U.S. PATENT DOCUMENTS

| | | | |
|---|---|---|---|
| 3,016,906 | 1/1962 | Peters | 19/81 X |
| 4,281,437 | 8/1981 | Marx | 19/80 R |
| 4,297,767 | 11/1981 | Leifeld | 19/80 R |

*Primary Examiner*—Louis K. Rimrodt
*Attorney, Agent, or Firm*—Spencer & Frank

[57] ABSTRACT

A bale opener includes an opening roller arranged for travel over fiber bales, opening elements on the opening roller arranged to engage top faces of the fiber bales, a grate travelling with the opening roller and formed of a plurality of parallel spaced grate bars each having opposite first and second ends and an arm rigidly connecting the first ends of the bars. The arm is supported for pivotal motion about a generally horizontal axis. The grate is open at the second ends of the grate bars, and the opening elements project between the grate bars towards the bale top. An abutment is supported in a swinging path of the second ends for constituting a stop cooperating with the second ends for determining a limit of their swinging path.

4 Claims, 4 Drawing Figures

GRATE FOR A FIBER BALE OPENER

BACKGROUND OF THE INVENTION

This invention relates to an apparatus for opening textile fiber bales and is of the type which has a rapidly rotating fiber opening (fiber removing) device (opening roller) which travels back and forth above a plurality of serially arranged fiber bales. The teeth or needles of the opening device project through a grate travelling with the opening device. The fiber tufts torn from the upper surface of the fiber bales by the opening roller are thrown thereby into a pneumatic conveying device. The bars of the grate are open at one end and are rigidly connected, at their other end, with a pivotally supported arm.

As the opening device is placed in its working position on the top of a bale, the grate bars are pushed upwardly by the top bale face. In prior art constructions, with the rotatably supported grate bar-connecting arm there is associated an abutment which limits the swinging motion of the grate. In case of particularly dense (substantially compressed) parts of the bale surface an additional upwardly surging vertical force may affect the grate. If, during such an occurrence the grate is already in engagement with the abutment, that is, the grate has already reached its limit position, the additional force may upwardly deform the grate which may adversely affect the operation of the bale opener.

SUMMARY OF THE INVENTION

It is an object of the invention to provide an apparatus of the above-outlined type in which a bending deformation of the bale opener grate is securely avoided.

This object and others to become apparent as the specification progresses, are accomplished by the invention, according to which, briefly stated, an abutment cooperates with the free (outer) ends of the grate bars.

According to the invention, the swinging motion of the outer free end of the grate bars is positively limited and thus the grate bars are prevented from undergoing a bending deformation, particularly in a vertical direction in response to external upwardly directed force surges during operation.

According to a further feature of the invention, the abutment which cooperates with the free ends of the grate bars is mounted at the lower end of a housing wall of the pneumatic tuft conveying apparatus associated with the bale opener. Preferably, the housing wall is, together with the abutment, pivotally supported to provide the possibility of placing the same in an outwardly swung position. For example, in the processing of certain chemical fiber bales, such an outward pivoting of the side wall and the abutment may be advantageous to ensure the inflow of a greater air stream for enhancing the tuft conveyance in the pneumatic conveying direction. In particular, in case of relatively soft fiber bales such as chemical fiber bales, a support of the free grate bars is often not required and therefore such outward pivoting motion places the abutment in an inoperative position. In this manner, the bale opener is adapted for the processing of relatively hard cotton bales and of relatively soft fiber bales and may be switched from one mode to the other in a rapid manner. Preferably, the lower end of the housing wall of the pneumatic conveying device has downwardly open notch-like recesses which may receive the free ends of the grate bars. Such an arrangement ensures that the free ends of the grate bars are seated in a form-fitting manner during operation and may not shift either vertically or horizontally, whereby risks of a bending deformation in a lateral direction are also avoided. In case a horizontally shiftable, laterally reciprocating grate is used, the apertured housing part may be supported either stationarily or may be shiftable together with the grate.

DESCRIPTION OF THE PREFERRED EMBODIMENTS

Figure 1:
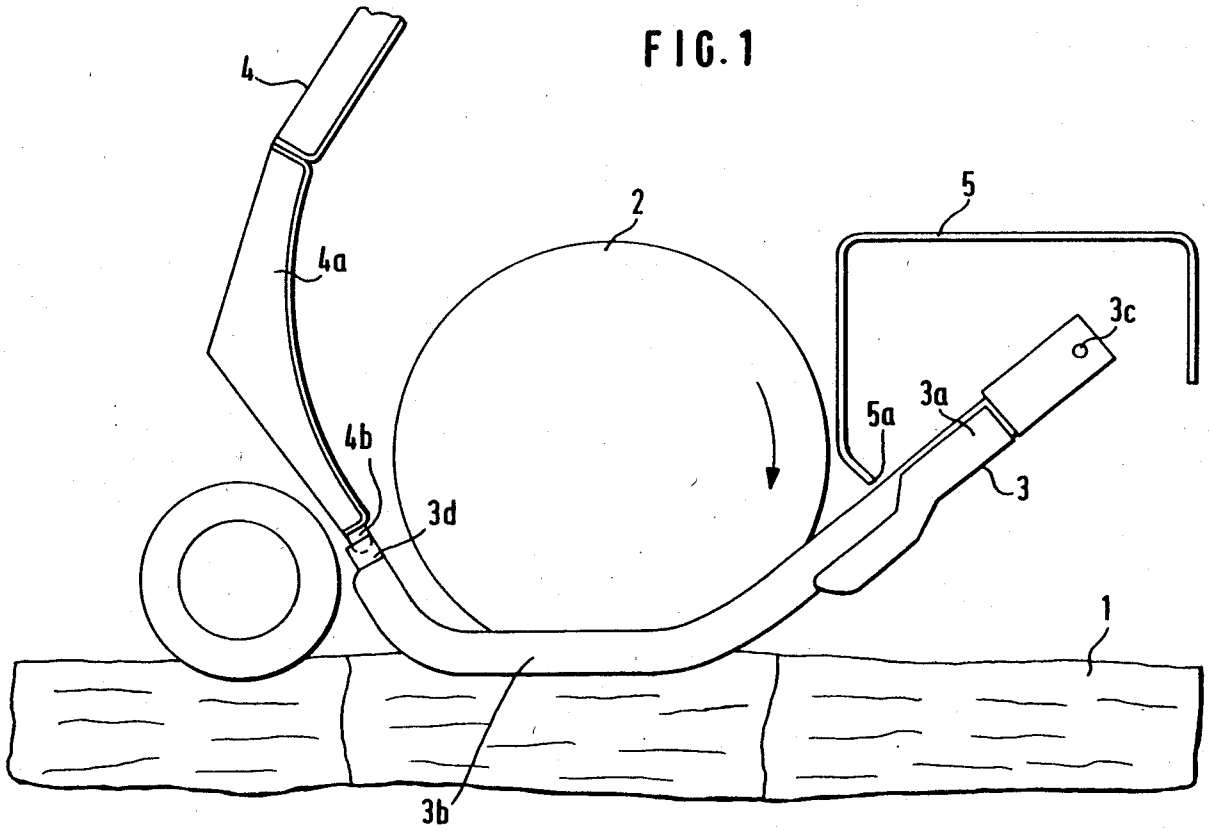
FIG. 1 is a schematic side elevational view of a preferred embodiment of the invention.

Turning to FIG. 1, there is shown a fiber bale opening device of the type described, for example, in U.S. Pat. No. 4,297,767 issued Nov. 3, 1981. The device has an opening roller 2, a grate formed of a plurality of parallel arranged spaced grate bars 3 and a pneumatic tuft conveying (removing) arrangement comprising a housing 4 which shrouds the opening roller 2 from above. The grate bars 3 each are angled and are divided into an arm 3*a* adjoined by an arm 3*b* which engages the fiber bales. At its one end each arm 3*a* is supported on the apparatus about a pivot 3*c*. The rotary motion of each grate bar 3 is limited by an abutment 5*a* formed at the end of a housing part 5. The free end 3*d* of each grate bar 3 is upwardly bent and is open (that is, the bars are not interconnected there by a cross member). Adjacent the open free ends 3*d* there is arranged an abutment constituted by the lower end 4*b* of a lateral wall 4*a* of the housing 4.

Figure 2A:
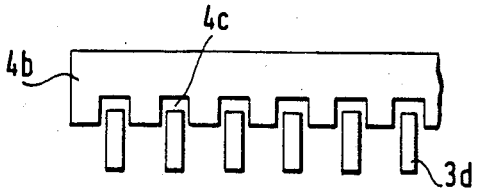
FIGS. 2*a* and 2*b* are front elevational views of a detail of the FIG. 1 construction, illustrating two different operational positions.
Figure 2B:
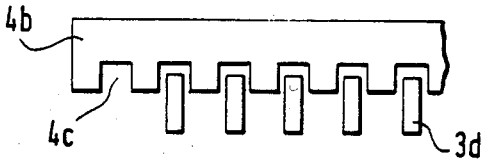

Turning to FIGS. 2*a* and 2*b*, the lower end (ledge) of the lateral wall 4*a* has downwardly open, notch-like recesses 4*c* into which may project the ends 3*d* of each grate bar 3. The notched ledge is stationarily supported. The grate is of the type described in U.S. Pat. No. 4,281,437, issued Aug. 4, 1981 and is thus of the alternatingly operating, laterally shifting type. Thus, upon completion of a pass the grate bars are shifted—after being moved out of the recesses—laterally in a horizontal direction so that the ends 3*d*, during the subsequent pass, will be associated with respectively adjoining recess 4*c*. This arrangement ensures that the free ends 3*d* are prevented from being bent during the fiber bale opening operation, either vertically or laterally, in a horizontal direction.

Figure 3:
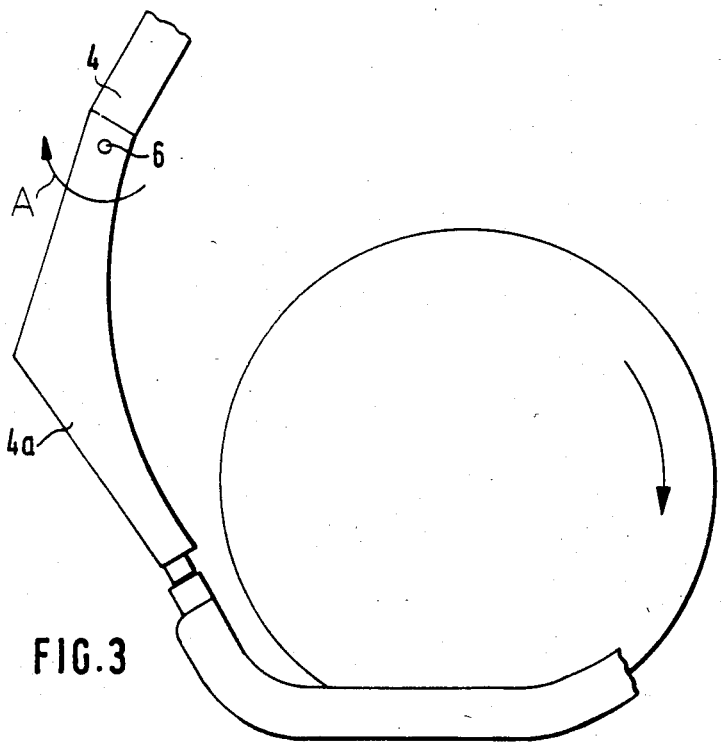
FIG. 3 is a schematic side elevational view of another preferred embodiment of the invention.

Turning now to the embodiment illustrated in FIG. 3, a lower wall portion 4*a* of the housing 4 is adapted to be swingable by virtue of a pivot 6 cooperating with the main housing part 4, in the direction of the arrow A. Locking means (not shown) may be provided to immobilize the housing part 4*a* in its inwardly pivoted (shown) position or in an outwardly pivoted position in which the abutment 4*b* is in a withdrawn, inoperative state. To place the wall 4*a* into its outwardly swung position may be advantageous in case soft fiber bales are utilized where, because external force surges are not expected, there are no appreciable risks of a bending deformation of the bars after they are in engagement with the abutment 5*a* at the housing part 5.

It will be understood that the above description of the present invention is susceptible to various modifications, changes and adaptations, and the same are intended to be comprehended within the meaning and range of equivalents of the appended claims.

What is claimed is:

1. In a bale opener including an opening roller arranged for travel over fiber bales, opening elements on the opening roller arranged to engage top faces of the fiber bales, a grate travelling with the opening roller and formed of a plurality of parallel spaced grate bars each having opposite first and second ends; an arm rigidly connecting the first ends of said bars; said arm being supported for pivotal motion about a generally horizontal axis; said grate being open at said second ends of said grate bars; said opening elements projecting between the grate bars towards the bale top; the improvement comprising an abutment supported in a swinging path of said second ends; said abutment constituting a stop cooperating with said second ends for determining a limit of said swinging path.

2. A bale opener as defined in claim 1, further comprising a pneumatic fiber tuft removing device comprising a housing shrouding the opening roller and travelling therewith, said housing including a lateral wall having a lower end; said abutment being mounted on said lower end.

3. A bale opener as defined in claim 2, wherein said lateral wall has upper and lower wall portions, said lower wall portion including said lower end and said abutment; further comprising pivotal means for pivotally securing said lower wall portion to said upper wall portion to provide for a swinging motion of said lower wall portion into a position away from said opening roller to move said abutment into an inoperative position out of said swinging path of said second ends of the grate bars.

4. A bale opener as defined in claim 2, wherein said abutment is formed of a plurality of serially arranged notches extending along said lower end; with each said second end there being aligned a separate one of said notches for receiving therein a respective said second end.

* * * * *